US007208401B2

(12) United States Patent
Nelson et al.

(10) Patent No.: US 7,208,401 B2
(45) Date of Patent: Apr. 24, 2007

(54) METHOD FOR FORMING A THIN FILM

(75) Inventors: Curt Nelson, Corvallis, OR (US); David Punsalan, Eugene, OR (US); Peter S. Nyholm, Austin, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 83 days.

(21) Appl. No.: 10/801,341

(22) Filed: Mar. 12, 2004

(65) Prior Publication Data

US 2005/0202681 A1 Sep. 15, 2005

(51) Int. Cl.
*H01L 21/44* (2006.01)

(52) U.S. Cl. ..... 438/609; 257/E21.479

(58) Field of Classification Search ..... 257/E21.479; 438/609

See application file for complete search history.

(56) References Cited

U.S. PATENT DOCUMENTS 5,169,672 A * 12/1992 Harima et al. ..... 427/458
5,188,902 A * 2/1993 Lin ..... 428/426
5,310,990 A * 5/1994 Russell et al. ..... 219/121.69
5,401,666 A 3/1995 Tsukamoto
5,466,617 A 11/1995 Shannon
5,626,670 A * 5/1997 Varshney et al. ..... 117/7
5,627,013 A * 5/1997 Kamisawa ..... 430/325
6,043,113 A 3/2000 Farrell
6,392,810 B1 5/2002 Tanaka
6,536,237 B1 3/2003 Jung
6,636,288 B2 10/2003 Kim et al.
6,641,254 B1 11/2003 Boucher et al.
6,653,030 B2 11/2003 Mei et al.
6,653,179 B1 11/2003 Minegishi et al.
6,664,147 B2 12/2003 Voutsas
6,667,188 B2 12/2003 Tanabe
6,686,978 B2 2/2004 Voutsas
6,690,033 B2 2/2004 Yamazaki et al.
6,690,437 B2 2/2004 Yamazaki et al.
2002/0016075 A1* 2/2002 Peng et al. ..... 438/700
2003/0207503 A1 11/2003 Yamazaki et al.
2003/0211666 A1 11/2003 Okumura
2003/0231263 A1 12/2003 Kato et al.
2004/0009678 A1 1/2004 Asai et al.
2004/0014261 A1 1/2004 Takahashi
2004/0033648 A1 2/2004 Matsunaga et al.
2004/0136891 A1* 7/2004 Kijima et al. ..... 423/263
2005/0087513 A1* 4/2005 Liao et al. ..... 216/54

FOREIGN PATENT DOCUMENTS

DE 258000 A * 7/1998

OTHER PUBLICATIONS

Chung et al., "Crystallization of Ultra—Low Temperature ITO by XeCl", Digest of Technical papers—Society For Information Display International Symposium (2002), 33, 57-59.*
Hosono et al., "Ecimer Laser Crystallization of Amorphous Indium—Tin—Oxide and Its Application in Fine Patterning", Japanese Journal of Applied Physics, Part 2: Letterss (1998), 37(10A), L1119-L1121.*
Randy Hoffman, "Development, Fabrication, and Characterization of Transparent Electronic Devices", Jun. 5, 2002, 144 Pgs.

* cited by examiner

*Primary Examiner*—Asok Kumar Sarkar

(57) ABSTRACT

Embodiments of methods, apparatuses, devices, and/or systems for forming a thin film are described.

42 Claims, 3 Drawing Sheets

METHOD FOR FORMING A THIN FILM

BACKGROUND

Electronic devices, such as integrated circuits, solar cells, and/or electronic displays, for example, may be manufactured from several material layers or films formed on a substrate. However, techniques for forming an electronic device may be time consuming, expensive, and/or produce inferior results.

BRIEF DESCRIPTION OF THE DRAWINGS

Subject matter is particularly pointed out and distinctly claimed in the concluding portion of the specification. The claimed subject matter, however, both as to organization and method of operation, together with objects, features, and advantages thereof, may best be understood by reference of the following detailed description when read with the accompanying drawings in which:

DETAILED DESCRIPTION

In the following detailed description, numerous specific details are set forth to provide a thorough understanding of the claimed subject matter. However, it will be understood by those skilled in the art that the claimed subject matter may be practiced without these specific details. In other instances, well-known methods, procedures, components and/or circuits have not been described in detail so as not to obscure the claimed subject matter.

Electronic devices, such as semiconductor devices, display devices, electrochromic devices, piezoelectric devices, nanotechnology devices, conductive, and/or dielectric devices, for example, may be comprised of one or more thin films, which may additionally be referred to as layers. In this context, the term thin film refers to a material formed to a particular thickness, such that particular surface properties of the material may be observed, and these properties may vary from bulk material properties, for example. These one or more layers may be further comprised of one or more materials, and the one or more materials may have particular electrical and/or chemical properties, such as a particular conductivity, particular optical properties, such as a particular transparency and/or refractive index, and/or a particular density, for example. The one or more material layers may additionally be patterned, and, in combination with one or more other patterned material layers, may form one or more electronic devices, such as thin films transistors (TFT), capacitors, diodes, resistors, photovoltaic cells, insulators, conductors, optically active devices, or the like. Thin film devices, such as TFTs, may, for example, be utilized in display devices including, for example, electroluminescent or liquid crystal displays (LCD). One particular type of patterned material layer may comprise a layer of electrically active metal oxide, for example, and may be referred to as an oxide thin film. Depending at least in part on the type of oxide utilized to form one or more such thin films, the resultant device may comprise a transparent or semi-transparent device. Thus, an oxide thin film may be formed on a substrate, and, when formed, may be electrically conductive or semiconductive, and may form a portion of an electronic device, such as the aforementioned TFT, for example.

Figure 1:
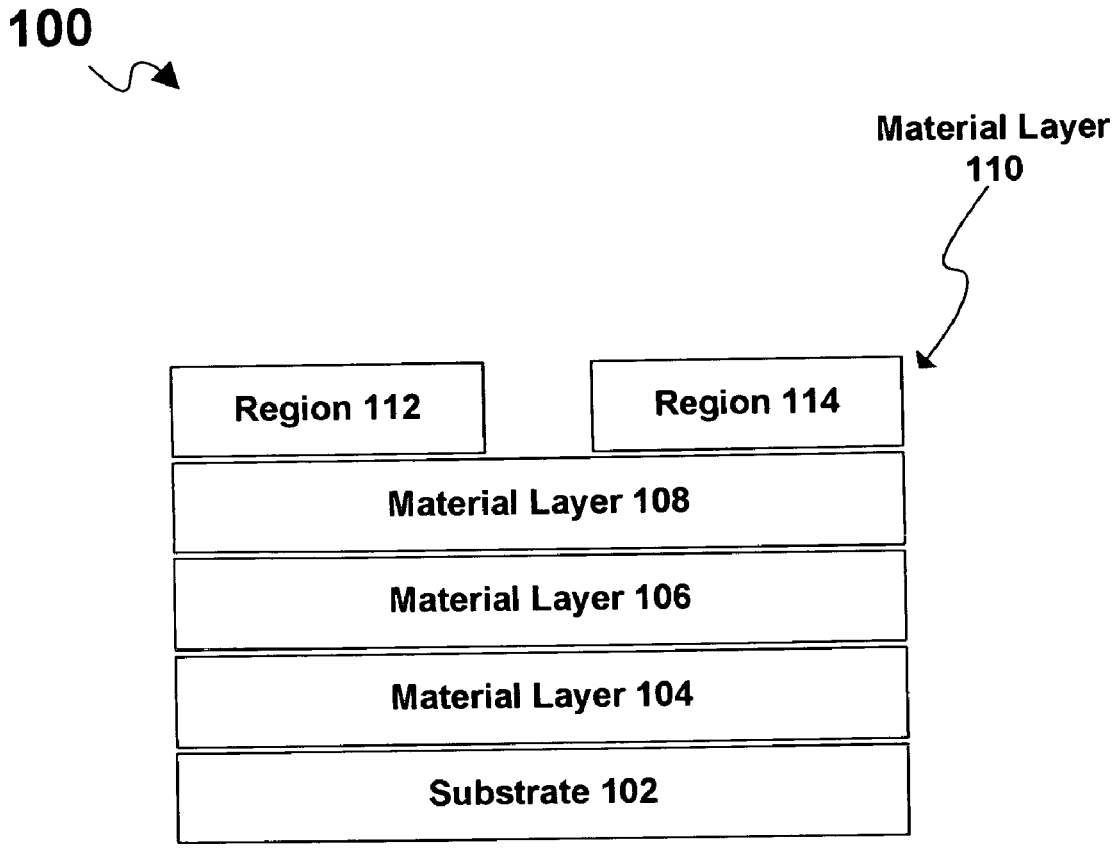
FIG. 1 is a cross-sectional view of one embodiment of a device.

Although the claimed subject matter is not so limited, in one embodiment of the claimed subject matter, a patterned material layer is formed by depositing a layer of material on at least a portion of a substrate by use of one or more deposition processes, and selectively annealing at least a portion of the material layer by use of one or more "spot" laser annealing processes. As used herein, selectively, when used, such as with annealing, for example, generally refers to annealing one or more portions of a material, such as a layer of material, wherein the portions are selected based at least in part on the particular location of the one or more portions, such as with localized or spot annealing, for example. Referring now to FIG. 1, there is illustrated an embodiment 100 of an electronic device comprising multiple layers. Embodiment 100 comprises substrate 102, and multiple material layers 104, 106, 108 and 110, as illustrated. Substrate 102 may comprise a substrate of glass, plastic, or silicon, or any combination of materials, such as polyethylene terephthalate (PET) or polyethylene naphthalate (PEN). Thus, substrate 102 may comprise any material exhibiting properties suitable for application as a substrate in an electronic device.

Formed on at least a portion of substrate 102 is material layer 104, which, in this embodiment, may comprise a transparent conductive oxide layer, such as indium tin oxide (ITO), for example, although the claimed subject matter is not so limited. For example, an embodiment of a device formed in accordance with the claimed subject matter may comprise a device having multiple homogeneous and/or heterogeneous material layers, or may comprise a device comprising one material layer, for example. One or more material layers may also comprise one or any combination of materials, such as metals, alloys, oxides and/or non-metal substances, including indium tin oxide, zinc tin oxide, zinc oxide (ZnO) and/or one or more organic materials such as PEDOT (Poly-3,4-Ethylenedioxythiophene), for example.

Continuing with this example, in this particular embodiment, formed on at least a portion of material layer 104 is an insulating material layer 106, which may comprise an oxide including aluminum titanium oxide (ATO), for example. Formed on at least a portion of material layer 106 is a dielectric material layer 108, which may comprise an oxide, such as ZnO, for example. Formed on at least a portion of material layer 108 is conductive material layer 110, which may comprise an oxide including ITO, for example.

In this particular embodiment, one or more layers may be patterned. Material layer 110 may be patterned into two regions 112 and 114, for example. When assembled and in a later manufactured state, device 100 may comprise a transparent or semi-transparent thin film transistor, with 102 comprising a substrate, as previously explained, material layer 104 comprising a gate, material layer 106 comprising a gate insulator, material layer 108 comprising a channel layer, and material layer 110 comprising a source 112 and a drain 114, for example. A transparent or semi transparent TFT, such as device 100, may provide advantages when utilized in optical applications, for example, although the claimed subject matter is not so limited.

Formation of the one or more material layers of device 100 may comprise several process operations. As stated previously, a substrate, such as substrate 102, may have one or more materials applied to at least a portion of at least one surface of the substrate. The one or more materials may be applied to a specified thickness, which may be a substantially uniform or substantially non-uniform thickness, and the thickness may depend at least in part on the type of material applied. For example, a liquid material may be applied to a desired wet film thickness, and may be selected based at least in part on tolerance for cracks when in a solidified state, for example. In one particular embodiment, a precursor material, such as a liquid precursor, for example, may be applied to at least a portion of at least one surface of the substrate. In one embodiment, a liquid precursor may comprise a sol-gel, which may comprise a colloidal solution, for example, and may be applied by one or more deposition processes, such as spin coating, for example.

In this embodiment, the liquid precursor sol-gel may comprise a solution, such as a colloidal solution, where one or more materials are dissolved in a solvent, such as an alcohol solvent. Types of materials suspended within the solvent vary, but may include inorganic metal salts and/or organic metal compounds, such as metal oxides. For example, zinc isopropoxide, or zinc chloride may be employed. Alternatively, other materials, such as compounds of zinc and/or other metals, and/or group VI elements of the period table (oxygen, sulfur, selenium, or tellurium, for example, oxide, sulfide, telluride, or selenide), may be employed; however, the claimed subject matter is not limited to these examples, of course.

Application of a liquid precursor may vary, but techniques including dipping, spraying, spin coating, vacuum deposition and/or spreading; however, again, the claimed subject matter is not limited to use of just these methods of application of a liquid precursor, and, additionally, the claimed subject matter is not limited to use of a liquid precursor.

After application of one or more materials, such as one or more precursors, to at least a portion of a substrate, at least a portion of the substrate and one or more material layer that have been applied may be annealed. Processes for annealing may vary, and may include oven annealing, rapid thermal processing (RTP), and/or laser annealing, for example. Any one of a number of annealing techniques may be applied to produce results, such as, without limitation, the techniques, described in, for example, *Handbook of Thin Film Technology*, Maissel, L. and Glang, R., available from Mcgraw-Hill, Inc., published 1970. Laser annealing, as may be employed in at least one embodiment, may be understood with reference to FIG. 2, below.

Figure 2:
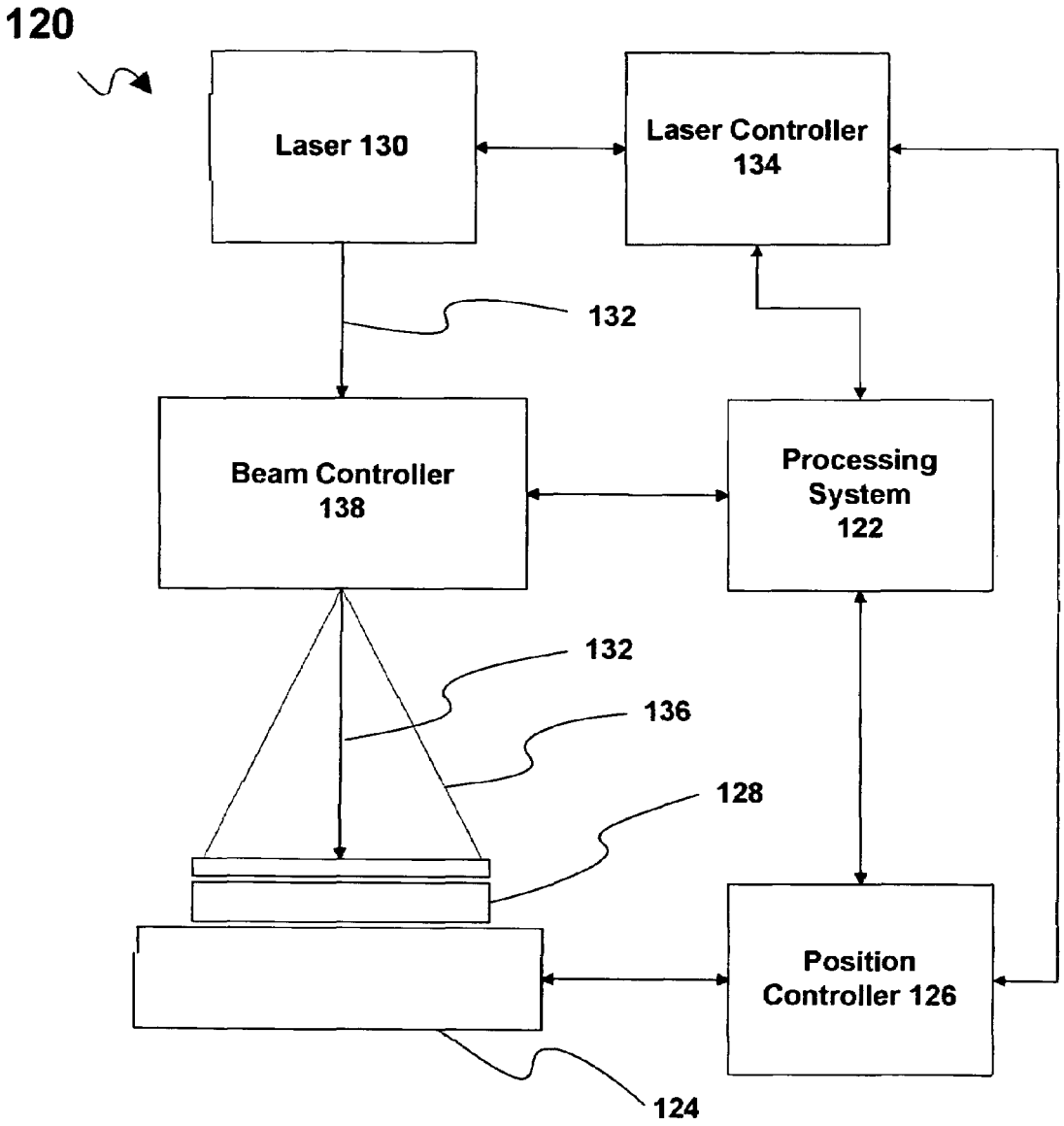
FIG. 2 is a schematic diagram illustrating an embodiment of a laser annealing system.

Illustrated in FIG. 2 is an embodiment 120 of a computer-controlled laser annealing system; however, laser annealing system embodiment 120 is merely one example of a system in accordance with the claimed subject matter. Many other system embodiments are possible and included within the scope of the claimed subject matter. This particular embodiment, however, 120, performs operations that may be implemented as software executing on a processor, hardware circuits, structures, or any combination thereof.

System 120 includes processing system 122, which may perform processing by interacting with and/or directing the actions of one or more components of laser annealing system 120, to perform various operations, as described in more detail below. Although not illustrated in detail, processing system 122 may comprise at least one processor and one or more memory components, such as Random Access Memory (RAM), Synchronous Dynamic Random Access Memory (SDRAM), and/or Static Random Access Memory (SRAM), for example. System 120 may further comprise: one or more hard drives; one or more removable media memory components, such as floppy diskettes, compact disks (CDs), tape drives; a display, such as a monitor, for example, and/or a user interface device, which may include a keyboard, mouse, trackball, voice-recognition device, or any other device that permits a user to input information and receive information.

Laser annealing system 120 may also comprise a support platform 124, as illustrated in FIG. 1, on which a partially formed device 128 may be supported when undergoing one or more laser annealing processes, for example. Partially formed device 128, in at least one embodiment, may comprise a substrate with one or more layers formed thereon, such as device 100 of FIG. 1, for example, although the claimed subject matter is not so limited. Furthermore, in this particular embodiment, platform 124 may be coupled to a position controller 126, which may alternatively be at least partially embodied inside platform 124. (not shown) In operation, position controller 126 may receive instructions from one or more software programs contained in memory, such as a memory of processing system 122, for example, which may be executed by one or more processors of processing system 122. Position controller 126 may result in partially formed device 128 to adjust position, such as based at least in part on a two or three-dimensional coordinate system, depending at least in part on one or more software programs being executed, for example. Alternatively, position controller 126 may be capable of controlling the position and/or direction of laser 130 (not shown), such as the angle of incidence, for example, or may control the relative positions of both platform 124 and laser 130 (not shown), for example.

Laser annealing system 120 further comprises a laser 130, which may be capable of generating a laser beam 132 at a particular frequency in the electromagnetic spectrum and having suitable energy to provide intense localized or "spot" heating. Laser annealing system 120 may also comprise a laser controller 134 coupled to laser 130, and may be configured to control the fluence, duration, and/or width of laser beam 132 when produced by laser 130. Furthermore, a beam controller 138 may be configured to perform various operations upon laser beam 132, including shaping the laser beam, changing the focal point, changing the frequency, changing the beam shape, and, perhaps, adjusting the direction and/or position of laser beam 132 within region 136 so that laser beam 132 can contact one or more points on partially formed device 128, although, as previously implied, depending on the embodiment, position controller 126 may, alternatively or in addition, affect the direction and/or position of laser beam 132 by affecting laser 130.

Additionally, system 120 may further comprise one or more laser beam homogenizers, condensers and/or mirrors (not shown), and, additionally, laser beam 132 may be projected through a mask, a galvanometer, or may be projected onto a contact mask (not shown), for example. One or more of these devices may be implemented as part of beam controller 138, for example, and may be implemented in order to modulate, direct, and/or control the laser beam.

Laser 130, laser controller 134, beam controller 138, and position controller 126 may, individually or in combination, be controlled by suitable instructions in a software program that is stored and executed by processing system 122, for example. A laser suitable for use in system 120 may comprise one or more types of laser, and may have a particular wavelength, power, and/or method of operation. Laser 130 may comprise, for example, a stepped or pulsed laser, and/or may be capable of producing a continuous beam. For example, in one embodiment, the laser may comprise a homogenized excimer laser, fired at a frequency of 200 Hz, with a wavelength of 248 nanometers (nm), fluence of 60 mJ/cm$^2$ (millijoules per unit area in square centimeters) or 100 mJ/cm$^2$, and operated with pulse capability for 100–3000 pulses, for example. Table 1 also lists other types of lasers that may be suitable for use in a system such as system 120, although, these few examples are not intended to limit the scope of the claimed subject matter in any way.

TABLE 1

| Laser Type | Laser Material | Wavelength(s) |
|---|---|---|
| Excimer | Argon Fluoride | 193 nm |
| | Krypton Fluoride | 248 nm |
| | Xenon Chloride | 308 nm |
| | Xenon Fluoride | 351 nm |
| Gas | Krypton | 476 nm, 528 nm |
| | Argon | 488 nm, 514 nm |
| | Copper Vapor | 510 nm |
| | HeNe | 633 nm |
| | Carbon Dioxide | 9600 nm, 10,600 nm |
| Solid State | Nd: YAG | 355 nm, 532 nm, 1064 nm |
| | Erbium | 1504 nm |
| Fiber | Ytterbium | 1060–1120 nm |

In operation, laser 130 may produce a continuous wave beam, or may be pulsed or Q-switched, for example, and the manner of operating laser 130 may depend on a variety factors, such as at least in part the material comprising one or more layers, and/or the type of laser, for example. In one embodiment, laser 130 may be operated in a pulsed manner, in which the laser beam may be pulsed sequentially by being turned on relatively briefly, e.g. for 20 nanoseconds (ns), and then turned off, while the beam is stepped or scanned to other regions to be annealed, or may operate to apply multiple pulses to single region, for example.

After one or more such regions or portions absorb the energy, or laser flux, provided by a laser beam, one or more material properties may become altered. For example, if the laser irradiates an area of a layer of sol-gel, the sol-gel may solidify, and/or may become at least partially crystalline or densified, e.g., made more dense, and/or may be altered chemically, such as to an oxide, for example, and/or optically, such as with respect to transparency and/or refractive index, for example. The amount of energy supplied by the laser may determine at least in part the affect on the area which absorbs the energy, and the energy may be dependent on a variety factors including, at least in part, the wavelength of the laser, the frequency, the fluence of the beam, the focal point of the beam, and/or the method of operation of the beam, as just a few examples. Additionally, the areas or regions annealed may be determined at least in part by adjusting one or more of these factors, such as, for example, selecting the focal point or wavelength such that a portion of a material layer below the surface of the layer is annealed, while the surface of the layer is not annealed.

Additionally, differing areas of device 128 may be subjected to differing amounts of energy by the laser, and this may allow device 128 to have varying material properties by selectively or "spot" annealing the material layer, resulting in selectively modifying material properties. As used herein, selectively, when used, such as with modifying material properties, for example, generally refers to modifying one or more portions of a material, such as by annealing, wherein the portions are selected based at least in part on the particular location of the one or more portions, such as with localized or spot annealing, for example. For example, portions of the device 128 may be annealed substantially uniformly, while other areas may not be substantially uniformly annealed. The laser may anneal a layer differently depending at least in part of the particular direction, such as the x, y, and z directions, for example, in a rectangular spatial coordinate system. This may result, for example, in forming a material layer with a concentration gradient of metal oxide through the layer, for example, or may result in the forming of a patterned layer of material, such as a patterned oxide layer, in which differing areas of a material layer have differing material properties, including varying conductivities, densities, optical properties and/or crystallinities, for example. This may allow the formation of a device, such as device 100, for example, without performing additional patterning processes. In this manner, a patterned material layer may be formed to have particular material properties at particular positions in the layer. Additionally, multiple material layers may be annealed during a laser annealing process, and differing portions of differing layers may be annealed selectively to form a device, such as a TFT, for example. The formation of a device with one or more material layers may be understood with reference to FIG. 3, below.

Figure 3:
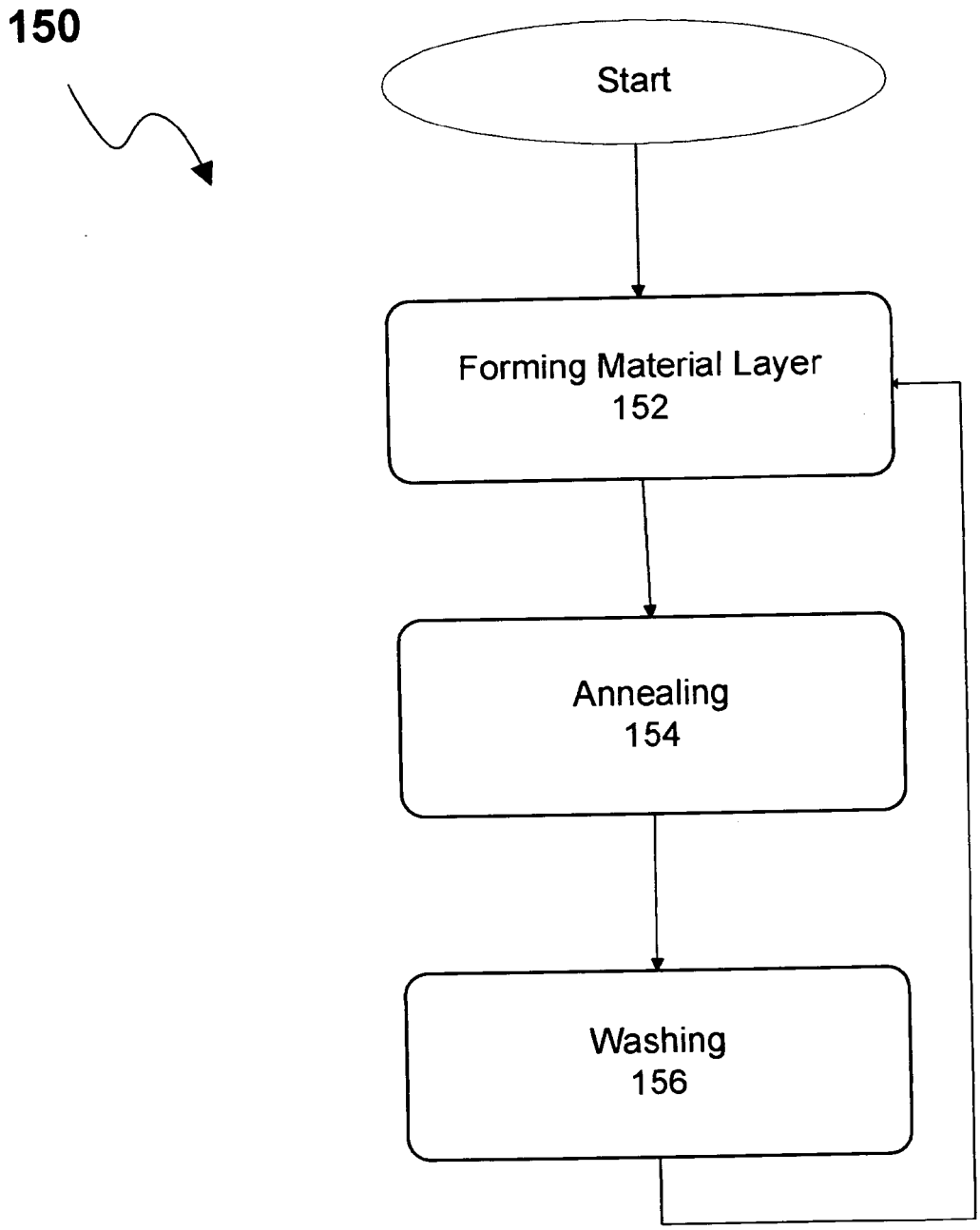
FIG. 3 is flowchart illustrating one embodiment of a method of forming an embodiment of a thin film.

Referring now to FIG. 3, one embodiment of a technique for forming a thin film is illustrated by a flowchart, although, of course, the claimed subject matter is not limited in scope in this respect. Thus, such an embodiment may be employed to at least partially form a thin film, as described below. The flowchart illustrated in FIG. 3 may be used to form a device at least in part, such as device 100 of FIG. 1, for example, although the claimed subject matter is not limited in this respect. Likewise, the order in which the blocks are presented does not necessarily limit the claimed subject matter to any particular order. Likewise, intervening additional blocks not shown may be employed without departing from the scope of the claimed subject matter.

Flowchart 150 depicted in FIG. 3 may, in alternative embodiments, be implemented in software, hardware and/or firmware, and may comprise discrete and/or continual operations. In this embodiment, at block 152, a material layer is formed on at least a portion of a substrate. At block 154, at least a portion of the material layer may be annealed, such as by "spot" annealing, for example. At block 156, at least a portion of the material layer may be washed. In at least one embodiment, one or more of the aforementioned operations may be repeated, such as to form a device with multiple material layers.

Forming a material layer may comprise one or more deposition processes, where a material or combination of materials is applied to a portion of a substrate, again, as illustrated at block 152. In particular, in one embodiment, the substrate may comprise a non-conductive substrate of glass or plastic, for example. Likewise, a material may comprise a liquid or semi-liquid, such as a sol-gel, and may be applied by one or more deposition methods, including, spraying, dipping, vacuum deposition, spreading and/or spin coating, for example. The material may be applied to a substantially uniform thickness, or may be substantially non-uniform, as previously described. In at least one example embodiment, the material may comprise a sol-gel at least partially comprising zinc isopropoxide and 2 ethylhexanoic acid in an alcohol solvent or zinc chloride in an alcohol solvent, and may be applied by a spin coating process. The material may be applied to a particular thickness, such as a selected wet film thickness, as described previously.

Continuing with this embodiment, at block 154, at least a portion of the material layer applied at block 152 may be annealed. Although methods for annealing may vary, in this embodiment, a laser system, such as system 120 of FIG. 2, may be utilized to perform one or more annealing processes. In this embodiment, a substrate with one or more material layers may be provided to a laser system and the laser may be operated to anneal at least a portion of one or more layers. One or more layers may be uniformly annealed, annealed to differing degrees, or may be selectively annealed at particular "spots" or positions, in order to form a layer of material having varying material properties, for example. By modifying one or more properties of the laser, such as wavelength, frequency, fluence, and/or duration, for example, differing material properties may be imparted to different areas of one or more material layers, such as differing degrees of crystallinity or consolidation. For example, in the example embodiment noted previously, a layer of sol-gel comprising zinc chloride in an alcohol solvent may be selectively annealed, forming regions of conductive zinc oxide in a material layer, for example. In this manner, a device, such as device 100 of FIG. 1, may be formed, and the resultant thin film transistor may be formed without performing additional patterning processes, for example. Alternatively, multiple material layers may be formed on the substrate prior to performing one or more annealing processes.

In this embodiment, moving to block 156, at least a portion of one or more material layers may be washed, and, in this embodiment, washing may result in the removal of one or more portions of the one or more layers. For example, if a material layer is selectively annealed at block 154, a portion of the layer not annealed may not be solidified, and may be removable by a wash. This may result in the forming of regions of exposed solidified material on a device, which may be further processed, such as by having other materials layered on the solidified portions, for example. In this manner, thin film electronic devices, such as thin film transistors, capacitors, resistors, photovoltaic cells and/or resistors, for example, may be formed.

It is, of course, now appreciated, based at least in part on the foregoing disclosure, that software may be produced capable of performing one or more of the foregoing operations, such as forming one or more material layers, and annealing at least a portion of the one or more layers. It will, of course, also be understood that, although particular embodiments have just been described, the claimed subject matter is not limited in scope to a particular embodiment or implementation. For example, one embodiment may be in hardware, such as implemented to operate on a device or combination of devices as previously described, for example, whereas another embodiment may be in software. Likewise, an embodiment may be implemented in firmware, or as any combination of hardware, software, and/or firmware, for example. Additionally, all or a portion of one embodiment may be implemented to operate partially in one device, such as a laser device, and partially in a computing device, for example. Likewise, although the claimed subject matter is not limited in scope in this respect, one embodiment may comprise one or more articles, such as a storage medium or storage media. This storage media, such as, one or more CD-ROMs and/or disks, for example, may have stored thereon instructions, that when executed by a system, such as a computer system, computing platform, or other system, for example, may result in an embodiment of a method in accordance with the claimed subject matter being executed, such as one of the embodiments previously described, for example. As one potential example, a computing platform may include one or more processing units or processors, one or more input/output devices, such as a display, a keyboard and/or a mouse, and/or one or more memories, such as static random access memory, dynamic random access memory, flash memory, and/or a hard drive, although, again, the claimed subject matter is not limited in scope to this example.

In the preceding description, various aspects of the claimed subject matter have been described. For purposes of explanation, specific numbers, systems and/or configurations were set forth to provide a thorough understanding of the claimed subject matter. However, it should be apparent to one skilled in the art having the benefit of this disclosure that the claimed subject matter may be practiced without the specific details. In other instances, well-known features were omitted and/or simplified so as not to obscure the claimed subject matter. While certain features have been illustrated and/or described herein, many modifications, substitutions, changes and/or equivalents will now occur to those skilled in the art. It is, therefore, to be understood that the appended claims are intended to cover all such modifications and/or changes as fall within the true spirit of the claimed subject matter.

The invention claimed is:

1. A method comprising:

a) forming a layer of sol-gel material on at least a portion of at least one surface of a substrate, the layer of sol-gel material being a precursor of a conductive material;

b) selectively modifying one or more material properties of at least a first portion of the formed layer of sol-gel material by selectively directing laser radiation on the first portion; and c) selectively removing at least a second portion of the formed layer of material.

2. The method of claim 1, wherein said at least a portion removed comprises material that is substantially unmodified in its material properties.

3. The method of claim 1 wherein the layer of material is formed by one or more deposition processes comprising one or more of: spin coating, spraying, dipping, spreading, or combinations thereof.

4. The method of claim 1, wherein said selective modifying further comprises:

performing one or more laser annealing processes on said at least one portion of the formed material layer.

5. The method of claim 4, wherein at least one of said laser annealing processes comprises localized annealing using a pulsed excimer laser.

6. The method of claim 4, wherein the formed material layer is selectively annealed, the selection being based at least in part on its position on said substrate.

7. The method of claim 1, wherein said material properties comprise one or more of: conductivity, consolidation, or crystallinity.

8. The method of claim 1, wherein the selective modifying of one or more material properties comprises laser annealing of at least the first portion of the formed layer of material.

9. The method of claim 1, wherein the second portion comprises at least a substantially unmodified portion of the formed layer of material.

10. The method of claim 1 further comprising irradiating the first portion and a third portion of the layer differently.

11. The method of claim 10, wherein the first portion overlies the third portion.

12. the method of claim 10, wherein the third portion is on a side of the first portion.

13. The method of claim 12, wherein the third portion is coplanar with the first portion.

14. The method of claim 10, wherein the first portion is irradiated with a first value and wherein the third portion is irradiated with a second different value for at least one of laser application properties selected from a group of properties consisting of: wavelength, frequency, fluence, focal point, and duration.

15. The method of claim 10, wherein the first portion and the third portion are differently irradiated such that the first portion and the third portion have at least one different characteristic.

16. The method of claim 15, wherein the at least one different characteristic is selected from a group of characteristics consisting of: conductivity, density, optical properties, and crystallinity.

17. The method of claim 1, wherein the second portion underlies or overlies the first portion.

18. The method of claim 1 further comprising irradiating the first portion of the layer with the laser having a first focal point or a first wavelength and irradiating a third portion of the layer with the laser having a second focal point or a second wavelength.

19. A method of forming a thin film, comprising:

a step for forming a layer of sol-gel material on at least a portion of at least one surface of a substrate, the layer of sol-gel material being a precursor of a conductive material, and a step for selectively modifying one or more material properties of at least one portion of the formed layer of sol-gel material.

20. The method of claim 19, and further comprising a step for removing at least a substantially unmodified portion of the formed layer of material.

21. The method of claim 19, wherein the layer of material is formed by one or more deposition processes comprising one or more of: spin coating, spraying, dipping, spreading, or combinations thereof.

22. The method of claim 19, wherein said step for selectively modifying further comprises:

a step for performing one or more laser annealing processes on said at least one portion of the formed material layer.

23. The method of claim 22, wherein at least one of said laser annealing processes comprises localized annealing with a pulsed excimer laser.

24. The method of claim 22, wherein the formed material layer is selectively annealed based at least in part on its position on said substrate.

25. The method of claim 19, wherein said material properties comprise at least one of: conductivity, consolidation, and crystallinity.

26. The method of claim 19, wherein said thin film comprises one or more thin films.

27. A transparent thin film electronic device, formed substantially by a process comprising:

forming one or more material layers on a substrate, at least one of the material layers being a sol-gel precursor of a conductive material;

selectively modifying at least a first portion of the sol-gel precursor of a conductive material; and removing at least a second portion of the one or more material layers, wherein the at least a second portion comprises one or more non-annealed portions of said one or more material layers.

28. The transparent thin film electronic device of claim 27, wherein said removing at least said second portion comprises removing material that is substantially unmodified in material properties.

29. The transparent thin film electronic device of claim 27, wherein said one or more material layers are formed by one or more deposition processes comprising one or more of: spin coating, spraying, dipping, spreading, or combinations thereof.

30. The transparent thin film electronic device of claim 27, wherein said selective modifying further comprises:

a process substantially comprising one or more laser annealing processes applied to said at least a portion of said one or more material layers.

31. The transparent thin film electronic device of claim 30, wherein at least one of said one or more laser annealing processes comprises localized annealing using a pulsed excimer laser.

32. The transparent thin film electronic device of claim 30, wherein said at least a portion of said one or more material layers is selected based at least in part on its position on said substrate.

33. The transparent thin film electronic device of claim 27, wherein said selective modifying comprises selective modification of material properties comprising at least one of: conductivity, consolidation, and crystallinity.

34. A method of forming a thin film comprising:

forming a layer of material on at least a portion of at least one surface of a substrate, the layer comprising a sol-gel material, the sol-gel material being a precursor of a conductive material;

irradiating a first portion of the layer with a first amount of energy with at least one laser; and irradiating a second portion of the layer with a second amount of energy with the at least one laser.

35. The method of claim 34, wherein the second portion underlies or overlies the first portion.

36. The method of claim 34, wherein the second portion is on a side of the first portion.

37. The method of claim 34, wherein the first portion is irradiated with a laser having a first focal point or a first wavelength and wherein the second portion is irradiated with a laser having a second focal point or a second wavelength.

38. The method of claim 34 further comprising removing a third portion of the layer which has not been substantially irradiated.

39. The method of claim 34 wherein the first portion and the second portion are differently irradiated such that the first portion and the second portion have at least one different characteristic.

40. The method of claim 39, wherein the at least one different characteristic is selected from a group of characteristics consisting of: conductivity, density, optical properties and crystallinity.

41. The method of claim 39 wherein the sol-gel material comprises a precursor of indium tin oxide (ITO).

42. A method of forming a thin film comprising:

forming a layer of material on at least a portion of at least one surface of a substrate, the layer of material being a precursor of a conductive material;

irradiating a first portion of the layer with at least one laser having a first focal point or first wavelength; and irradiating a second portion of the layer with the at least one laser having a second focal point or a second wavelength.

* * * * *